US009097010B2

(12) United States Patent
Larkin

(10) Patent No.: US 9,097,010 B2
(45) Date of Patent: Aug. 4, 2015

(54) DEVICE FOR SECURING ONE FACE WALL MESH TO VERTICAL REBAR AND STANDARD CONCRETE FORMS

(71) Applicant: James Larkin, Scarsdale, NY (US)

(72) Inventor: James Larkin, Scarsdale, NY (US)

( * ) Notice: Subject to any disclaimer, the term of this patent is extended or adjusted under 35 U.S.C. 154(b) by 0 days.

(21) Appl. No.: 13/898,330

(22) Filed: May 20, 2013

(65) Prior Publication Data

US 2014/0041333 A1 Feb. 13, 2014

Related U.S. Application Data

(60) Provisional application No. 61/681,134, filed on Aug. 8, 2012.

(51) Int. Cl.

| | |
|---|---|
| ***E04B 1/38*** | (2006.01) |
| ***E04C 5/00*** | (2006.01) |
| ***E04B 2/86*** | (2006.01) |
| ***E04C 5/12*** | (2006.01) |
| ***E04B 1/41*** | (2006.01) |
| *B21F 1/06* | (2006.01) |
| *E04C 5/20* | (2006.01) |
| *E04C 5/16* | (2006.01) |
| *B21F 1/00* | (2006.01) |

(52) U.S. Cl.

CPC ..... *E04B 2/8647* (2013.01); *E04B 1/4178* (2013.01); *E04C 5/12* (2013.01); *B21F 1/00* (2013.01); *B21F 1/06* (2013.01); *E04B 2/86* (2013.01); *E04C 5/167* (2013.01); *E04C 5/20* (2013.01); *Y10T 24/149* (2015.01); *Y10T 403/7176* (2015.01)

(58) Field of Classification Search

CPC . Y10T 403/7176; Y10T 24/149; E04C 5/161; E04C 5/167; E04C 5/20; E04C 5/12; B21F 1/00; B21F 1/06; E04B 1/4178; E04B 2/8647

USPC ..... 52/699, 698, 749.1, 749.13, 750, 52/741.15, 712, 719, 713, 686, 685, 665; 256/57; 245/3; 248/302; 24/457, 24/26–29; 404/134; 403/213, 206, 209

See application file for complete search history.

(56) References Cited

U.S. PATENT DOCUMENTS

| | | | | | |
|---|---|---|---|---|---|
| 1,498,595 | A | * | 6/1924 | Wedmore | 52/719 |
| 2,843,230 | A | * | 7/1958 | Nelsson | 403/387 |
| 3,168,912 | A | * | 2/1965 | Marica | 140/101 |
| 3,473,285 | A | * | 10/1969 | Reiland | 52/745.17 |
| 4,999,965 | A | * | 3/1991 | Schmidgall et al. | 52/684 |
| 5,042,218 | A | * | 8/1991 | Nasca et al. | 52/677 |
| D330,846 | S | * | 11/1992 | Woolledge et al. | D8/354 |
| 5,287,672 | A | * | 2/1994 | Moore | 52/654.1 |
| 5,392,580 | A | * | 2/1995 | Baumann | 52/660 |
| 5,678,952 | A | * | 10/1997 | Shaw et al. | 404/62 |
| 5,743,678 | A | * | 4/1998 | Pitre | 405/259.1 |
| 5,924,458 | A | * | 7/1999 | Kaines | 138/175 |
| 6,536,180 | B1 | * | 3/2003 | Rosenblat et al. | 52/712 |
| 6,655,105 | B2 | * | 12/2003 | Swenson | 52/677 |
| 7,377,083 | B2 | * | 5/2008 | McCafferty et al. | 52/719 |
| 2005/0055956 | A1 | * | 3/2005 | Hardy | 52/698 |

* cited by examiner

*Primary Examiner* — Chi Q Nguyen

(57) ABSTRACT

A simple, one-piece mechanical tie allows quick and secure connection between rebar, mesh and form. A single piece of tie wire can secure the tie to the mesh and rebar, making the installation process much quicker than conventional processes. Unlike other devices that have multiple pieces where, if one piece is lost, the tie is unusable, the current device is designed as a single piece making installation and use quick and simple.

8 Claims, 3 Drawing Sheets

DEVICE FOR SECURING ONE FACE WALL MESH TO VERTICAL REBAR AND STANDARD CONCRETE FORMS

CROSS-REFERENCE TO RELATED APPLICATION

This application claims the benefit of priority of U.S. provisional application No. 61/681,134, filed Aug. 8, 2012, the contents of which are herein incorporated by reference.

BACKGROUND OF THE INVENTION

The present invention relates to concrete wall forming devices and methods and more particularly, to device for securing one face wall mesh to vertical rebar and standard concrete forms.

In the construction of concrete walls of fixed width, securing one face wall mesh to rebar and forms is an expensive and cumbersome process. Conventional ties for this purpose are made up of multiple parts that either had to be connected and adjusted for the width of the concrete wall, or secured with a nut and link. If one piece was lost, the tie was unusable.

As can be seen, there is a need for a simple, one-piece tie design that allows the tie to be easily handled and installed by whomever is installing the mesh and form and pouring the concrete.

SUMMARY OF THE INVENTION

In one aspect of the present invention, a device for securing one face wall mesh to vertical rebar and standard concrete forms comprises a tie rod; a bend formed in a first direction at a first end of the tie rod; a U-bend, formed in a second direction, opposite that of the first direction, the U-bend having a curvature operable to retain rebar therewithin; and a shaft tie operable to wrap around an opening formed by the U-bend, proximate to the bend in the tie rod.

In another aspect of the present invention, a device for securing one face wall mesh to vertical rebar and standard concrete forms comprises a tie rod having a first end and a second end; a bend formed in a first direction at the first end of the tie rod; a U-bend, formed in a second direction, opposite that of the first direction, located adjacent the bend, the U-bend having a curvature operable to retain rebar therewithin; a wire tie operable to wrap around an opening formed by the U-bend, proximate to the bend in the tie rod; and one of a knob and a loop disposed on a second end of the tie rod.

In a further aspect of the present invention, a method for securing one face wall mesh to vertical rebar and standard concrete forms comprises bending a tie rod in a first direction at a first end of the tie rod; forming a U-bend in a second direction, opposite that of the first direction; retaining rebar in a curvature formed by the U-bend; and wrapping a shaft tie around an opening formed by the U-bend, proximate to the bend in the tie rod.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a simple, one-piece mechanical tie that allows quick and secure connection between rebar, mesh and form. A single piece of tie wire can secure the tie to the mesh and rebar, making the installation process much quicker than conventional processes. Unlike other devices that have multiple pieces where, if one piece is lost, the tie is unusable, the device of the present invention is designed as a single piece making installation and use quick and simple.

Figure 1:
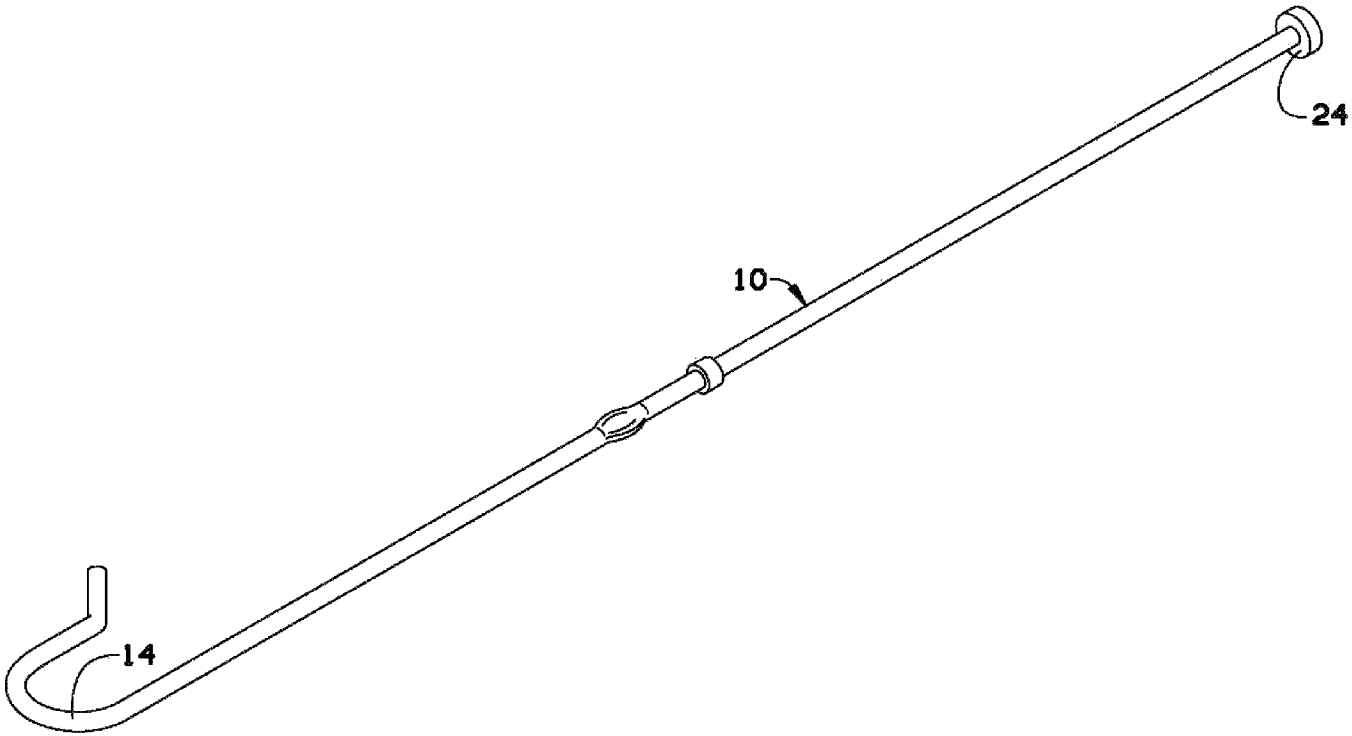
FIG. 1 is a perspective view of a knob style tie according to an exemplary embodiment of the present invention.
Figure 2:
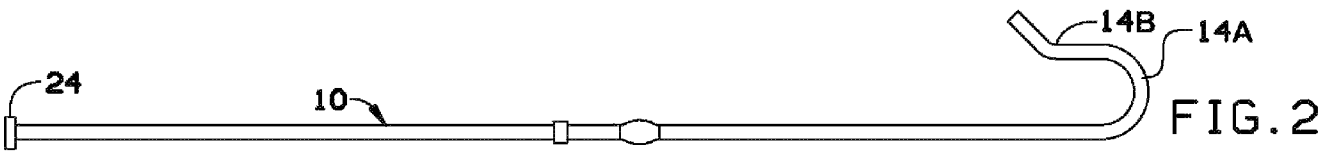
FIG. 2 is a side view of the knob style tie of FIG. 1.
Figure 3:
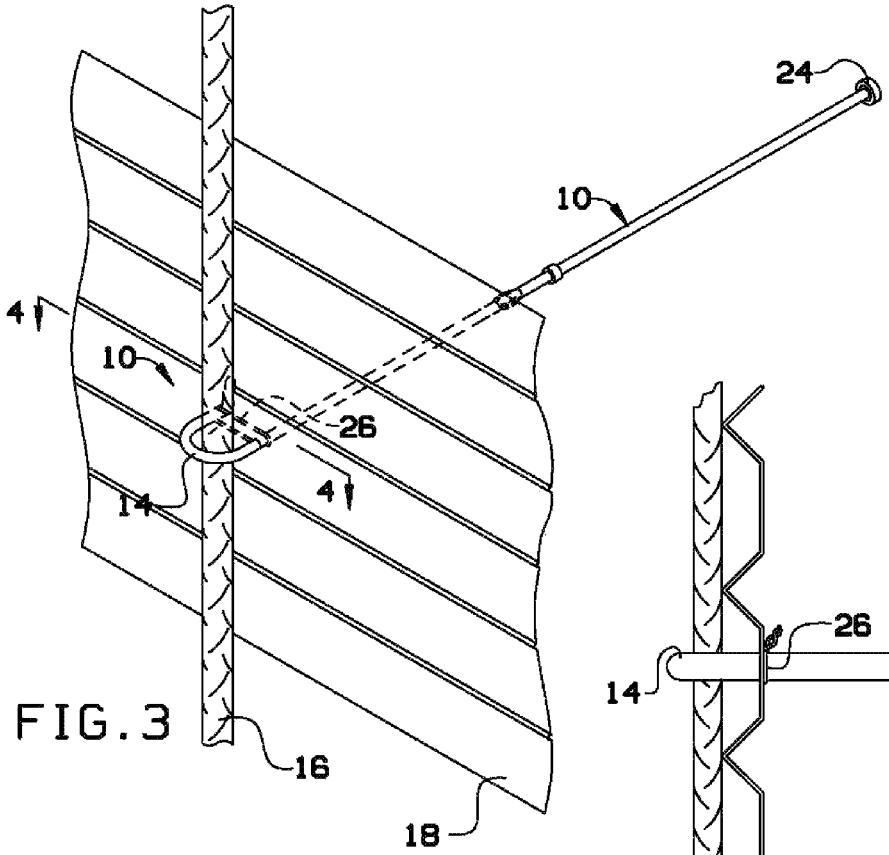
FIG. 3 is a perspective view of the tie of FIG. 1, in use to secure vertical rebar to a concrete form.
Figure 5:
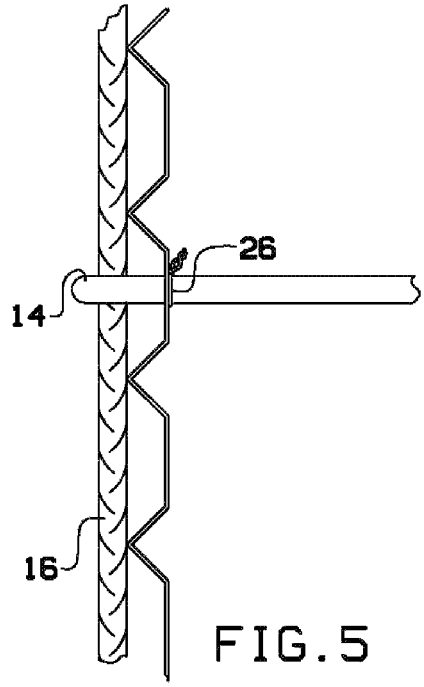
FIG. 5 is a side view of the rebar/concrete form tie in use as shown in FIG. 3.
Figure 4:
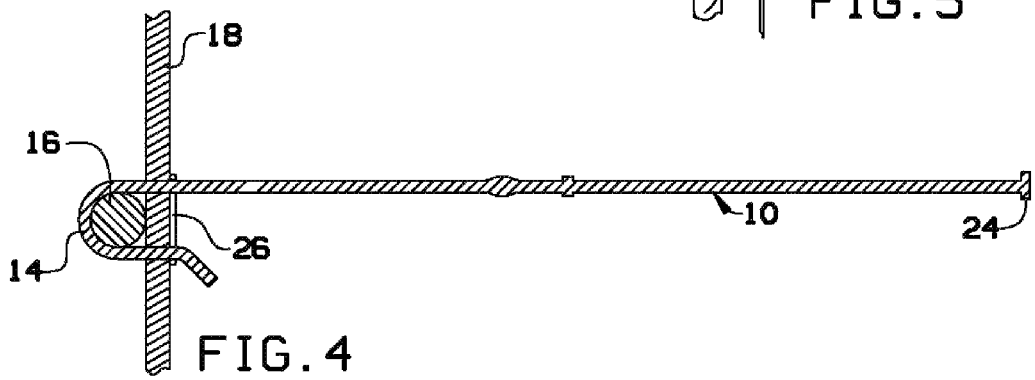
FIG. 4 is a cross-sectional view as taken along line 4-4 of FIG. 3.

Referring now to FIGS. 1 through 5, a knob style tie 10 can include a bend 14 at a first end thereof. The bend 14 can include a first bend 14-1 (see FIG. 2), having a curved radius causing the tie to bend back on itself (about 180 degrees), and a second bend 14-2 causing the first end of the tie to bend away from the tie at an angle from about 30 to about 70 degrees. Typically the first bend 14-1 can have a radius designed to receive rebar 16 therein. A knob 24 can be disposed on the end of the knob style tie 10. A connector 26, such as a tie of wire, can be secured from the second bend 14-2 to the tie prior to the first bend 14-1, as shown in FIG. 4.

Figure 6:
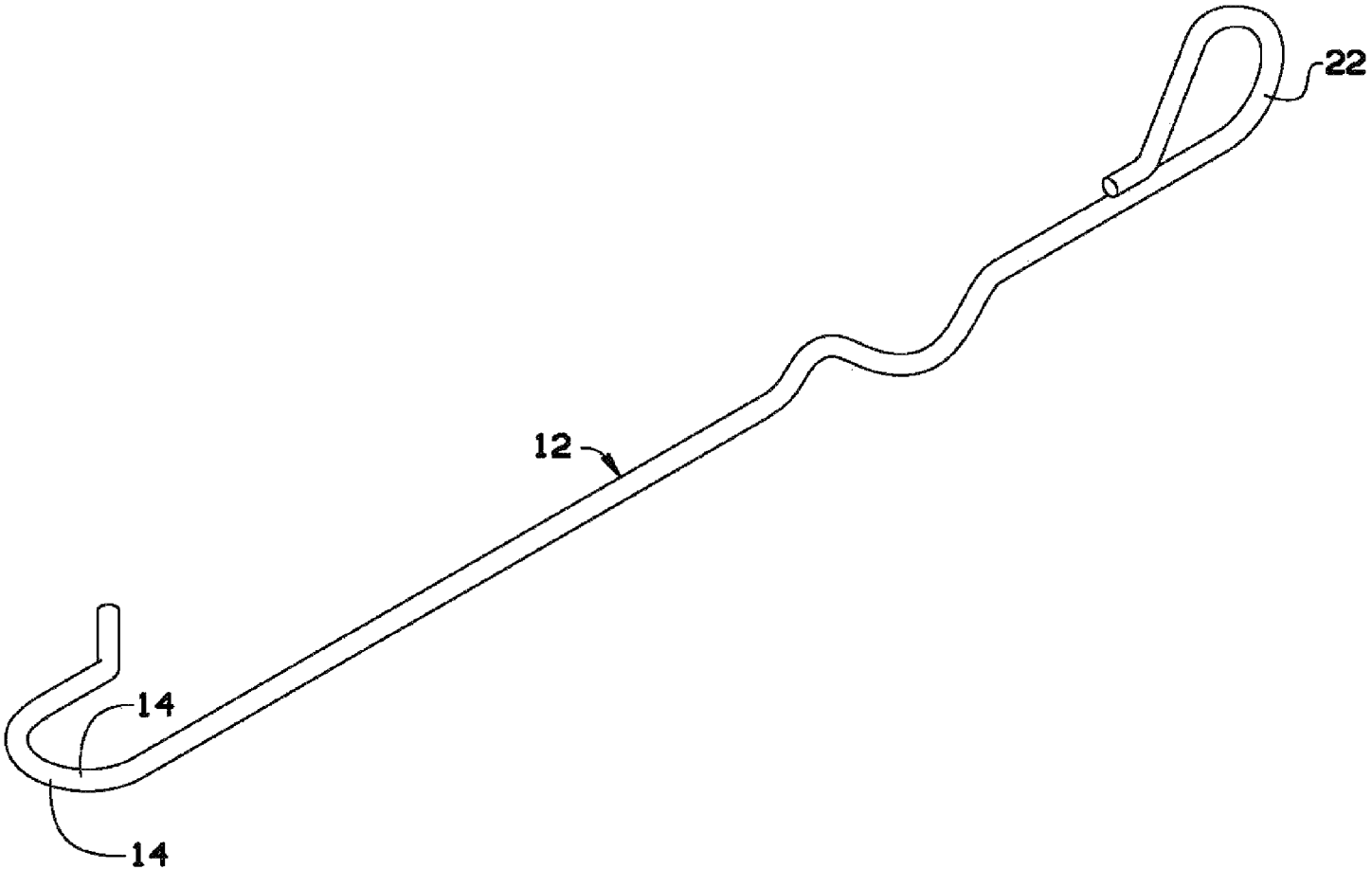
FIG. 6 is a perspective view of a loop style tie according to another exemplary embodiment of the present invention.

Referring to FIG. 6, a loop style tie 12 can be designed similar to the knob style tie 10, described above, except that a loop 22 can be disposed at the end thereof in place of the knob 24.

To make the tie of the present invention, a standard snap tie or loop tie can be cut to the appropriate length. The cut end of the tie can then be deformed at the end to act as a catch for the wire used to secure the tie. The tie can then be bent into a 180 degree bend (first bend 14-1), creating an inside radius capable of hooking around an existing installed rebar 16 and extending through the one faced wall mesh 18. With the tie 10, 12 hooked around the rebar 16 and sticking through the mesh 18, a single tie of wire (connector 26) can be secured around the step of the tie and under the deformed end (second bend 14-2) of the tie. Thus secured, the mesh 18 cannot slide off the tie 10, 12 and the tie cannot slide off the rebar 16.

Depending on the forming system in use, the loop end 22 or the snap end 24 of the tie is secured through the strippable side of the wall, making a complete rigid chamber for the pouring of a concrete wall in a fixed diameter.

The system of the present invention can provide the user with a quick and secure connection between the rebar, mesh and form, greatly simplifying the process as compared to conventional methods.

It should be understood, of course, that the foregoing relates to exemplary embodiments of the invention and that modifications may be made without departing from the spirit and scope of the invention as set forth in the following claims.

What is claimed is:

1. A device for securing one face wall mesh to vertical rebar and standard concrete forms comprising:

a tie rod;

a bend formed in a first direction at a first end of the tie rod;

a U-bend, formed in a second direction, opposite that of the first direction, the U-bend having a curvature operable to retain rebar therewithin, wherein the bend is closer to the first end than the U-bend;

a looped shaft tie wrapped around a portion of the tie rod prior to the U-bend and wrapped around the bend, thereby covering an opening formed by the U-bend; and a knob on a second end of the tie rod.

2. The device of claim 1, wherein the bend is from about 30 to about 70 degrees.

3. The device of claim 1, wherein the U-bend is about 180 degrees in the shape of a U.

4. The device of claim 1, wherein the shaft tie is a wire tie.

5. The device of claim 1, further comprising a loop on a second end of the tie rod.

6. A device for securing one face wall mesh to vertical rebar and standard concrete forms, comprising:

a tie rod having a first end and a second end;

a bend formed in a first direction at the first end of the tie rod;

a U-bend about 180 degrees, formed in a second direction, opposite that of the first direction, located adjacent the bend, the U-bend having a curvature operable to retain rebar therewithin, wherein the bend is closer to the first end than the U-bend, and wherein the bend and the U-bend are planar;

a looped shaft tie wrapped around a portion of the tie rod prior to the U-bend and wrapped around the bend, thereby covering an opening formed by the U-bend; and a knob disposed on a second end of the tie rod.

7. A method for securing one face wall mesh to vertical rebar and standard concrete forms, comprising:

bending a tie rod in a first direction at a first end of the tie rod, wherein a knob is disposed on a second end of the tie rod;

forming a U-bend in a second direction, opposite that of the first direction;

retaining rebar in a curvature formed by the U-bend; and wrapping a looped shaft tie around a portion of the tie rod prior to the U-bend and wrapped around the bend, thereby covering an opening formed by the U-bend.

8. The method of claim 7, wherein the shaft tie is a wire tie.

* * * * *